United States Patent [19]

Nelson et al.

[11] Patent Number: 4,832,291

[45] Date of Patent: May 23, 1989

[54] TRASH BAG HOLDER

[76] Inventors: Dean O. Nelson, 1775 Hacienda Ave., Campbell, Calif. 95008; Richard W. Nelson, 1496 Hervey Lane, San Jose, Calif. 95125

[21] Appl. No.: 74,263

[22] Filed: Jul. 16, 1987

[51] Int. Cl.[4] ..... B65B 67/04

[52] U.S. Cl. ..... 248/99

[58] Field of Search ..... 248/95, 99, 101; 294/55, 19.1; 141/108, 109; 220/440; 383/34; 15/257.1

[56] References Cited

U.S. PATENT DOCUMENTS

| | | | |
|---|---|---|---|
| 289,721 | 12/1883 | Smith | 248/99 X |
| 544,585 | 8/1895 | Mayo | 248/100 X |
| 960,451 | 6/1910 | Vicary | 248/99 |
| 991,081 | 5/1911 | Parr | 248/99 |
| 1,426,528 | 8/1922 | White | 248/99 |
| 1,474,634 | 11/1923 | Johanns | 294/55 |
| 2,383,366 | 8/1945 | Broome | 248/100 |
| 3,149,809 | 9/1964 | Leyy | 248/99 |
| 3,260,488 | 7/1966 | Kliewer et al. | 248/99 |
| 4,245,411 | 1/1981 | McMath | 294/55 X |
| 4,664,348 | 5/1987 | Corsant, III et al. | 248/99 |
| 4,669,690 | 6/1987 | McEniry | 248/101 |

FOREIGN PATENT DOCUMENTS

| | | | |
|---|---|---|---|
| 567965 | 10/1975 | Switzerland | 248/101 |
| 1890 | 2/1891 | United Kingdom | 248/99 |
| 19617 | 9/1903 | United Kingdom | 248/99 |

*Primary Examiner*—Alvin C. Chin-Shue
*Attorney, Agent, or Firm*—John J. Leavitt

[57] ABSTRACT

A hoop, fitting readily into the mouth of a plastic trash bag, is peripherally expandable to fit tightly against the inner surface of the bag and hold the bag securely in place with the mouth open. The hoop has provision for either free-standing use with the bag mouth in the vertical position, when trash may be swept directly into the opening, or mounting on a vertical support with the bag mouth in the horizontal position for use as a trash receptacle. A pan attached by a hinge to the hoop serves both as a threshold when sweeping trash into the bag, and as a lid when the bag is used as a trash receptacle. The hinged pan also permits compact storage and transportation.

2 Claims, 2 Drawing Sheets

TRASH BAG HOLDER

BACKGROUND OF THE INVENTION

1. Field of the Invention

This invention relates to devices for holding bags in an open position for filling, and in particular to devices facilitating the filling of trash bags used for disposing of garden, industrial and commercial waste.

2. Description of the Prior Art

The prior art related to this invention is believed to reside in Class 248, sub-classes 95, 97, 99 and 100.

A preliminary patentability search through this area has indicated the existence of the following U.S. Pat. Nos.: 4,659,045; 3,754,785; 4,052,764.

While all of the patents noted above relate to trash bag holders, perhaps the most pertinent is U.S. Pat. No. 4,659,045 which discloses a kit containing a rigid hollow frame structure through which a plastic bag is inserted, the opening of the bag then being spread over the perimeter of the frame. The other component of the kit is a detached folded sheet metal piece for use as an inclined ramp, dustpan and scraper. As will become readily apparent, while this prior art bears a superficial resemblance in overall shape to the present invention, there are a number of distinguishing features and important innovations in the present invention which are absent from the cited patent.

One of the objects of the present invention is to provide a device which can spread the open end of a plastic bag so as to produce a large and unobstructed opening, and to maintain the opening in this condition during use.

A further object of the invention is to be able to expand the bag opening from inside the mouth of the bag with a hoop having a variable peripheral dimension, so that the hoop may be readily introduced into the mouth of the bag, but may then be expanded to produce a tight fit against the inner surface of the bag, thereby preventing the bag from slipping off the hoop.

As it is intended that this device shall be capable of use in a wide a variety of trash collecting situations it is an additional object of the invention that a stable opening and connection to the bag is provided for all possible orientations of the opening. Thus, provision is made for the opening to be vertical and free-standing on the ground when used for collecting leaves and other garden trash, and also to be mountable above ground on a fixed or movable support with the opening in a horizontal position for more general waste collection.

Providing a means to facilitate the movement of trash into the bag is a further object of the invention. This is accomplished by the provision of a specially designed pan attached by a hinge to the hoop. The pan acts as a threshold or entrance ramp for easing the task of, for example, sweeping or raking leaves through the opening of the bag. The pan serves a similar role by acting as a backplate when the opening of the bag is horizontal, and as a lid when folded down over the horizontally oriented opening.

For storage and transportation purposes associated with both use and commercial sale and distribution a compact design is important. To this end an additional objective of the invention is realized by the ability to fold the pan over the hoop and into a compact configuration.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

The present invention provides a device for holding the entrance of a bag or sack in an open position and at suitable orientations for ease of filling. Provision is also made for facilitating the filling process.

This is accomplished by placing a flexible hoop on the inside edge of the entrance to a plastic or other suitable bag in order to hold the entrance of the bag in the open position. A means for expanding the peripheral dimension of the hoop is provided such that the hoop tightens against the inner wall of the bag and holds the bag firmly in position on the hoop.

The further orientation of the open entrance of the bag is now at the convenience of the user since the opening may be readily placed or fixed in either a vertical or horizontal position, means for both of which are provided by the invention.

Filling the bag when the open entrance is in either a vertical or horizontal position is assisted by a facilitating means, for moving materials towards the open bag entrance, in the form of an attached pan, threshold, ramp or backplate. This attached pan further serves as a lid when the device is used with the bag entrance in the horizontal position.

DESCRIPTION OF THE PREFERRED EMBODIMENT

Figure 1:
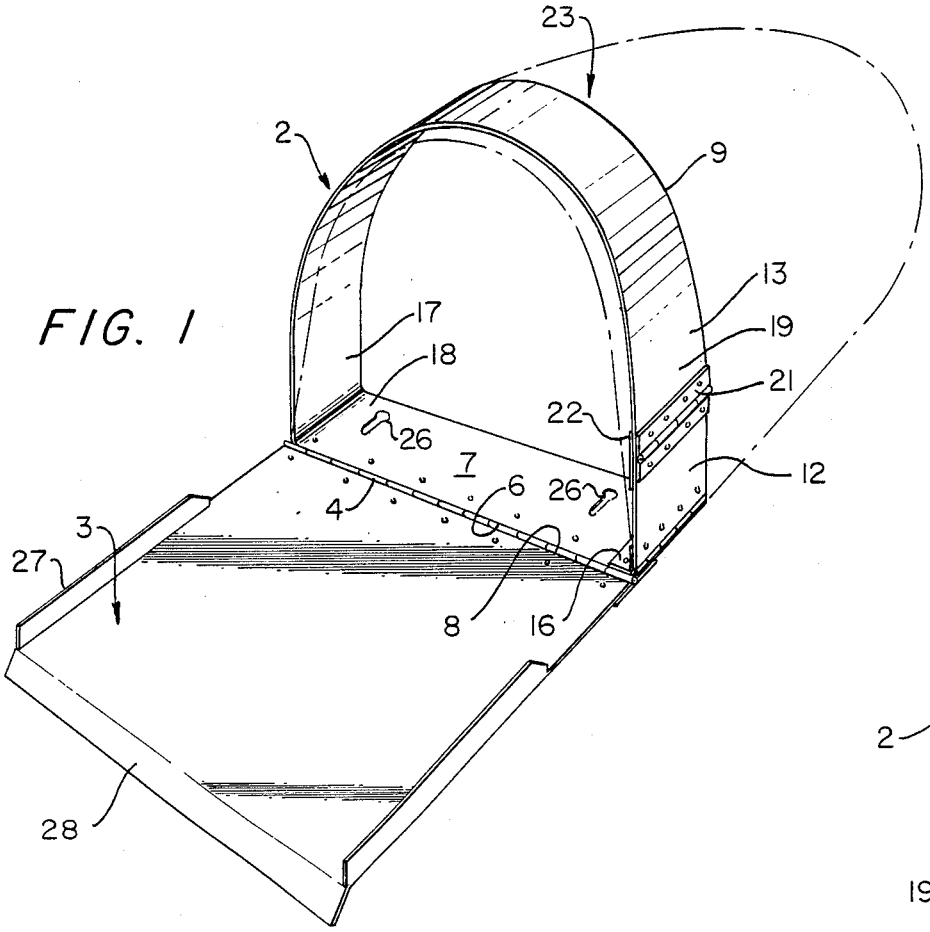
FIG. 1 is a perspective view of the holder in expanded mode with a trach bag secured in place and the pan in the threshold position for horizontal filling of the sack.
Figure 2:
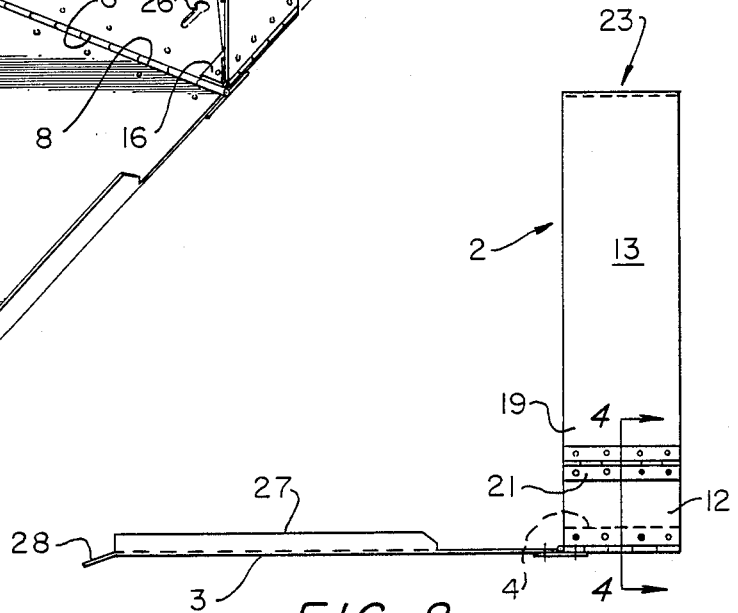
FIG. 2 is a side elevation of the holder in expanded mode with the pan in the threshold position.

An embodiment of the invention which is particularly effective is illustrated in the accompanying drawings and has two major components: a hoop 2 and a rectangular pan 3. These two components are joined by a long hinge 4 connecting one long edge 6 of the flat member 7 of the hoop to the rear edge 8 of the rectangular pan.

The curved member 9 of the hoop contains two inherently resilient segments 12 and 13. One end 14 of the short segment 12 is connected through a first hinge 16 to one end of the rigid flat member 7 so that the inner surfaces of the short segment and the flat member may come into contact with each other, or present a variable angle to each other. One end 17 of the long segment 13 is rigidly and perpendicularly attached to the remaining end 18 of the flat member 7. The other end 19 of the long segment 13 is connected through a second hinge 21 to the outer surface of the short segment 12 in such a way as to cause the inner surface of the hinged end of the long segment to partially overlap the outer surface of the free end 22 of the short segment, the free end 22 thereby acting as a stop and restricting outward movement of the two segments to the form of a smooth curve at the second hinge 21.

Figure 3:
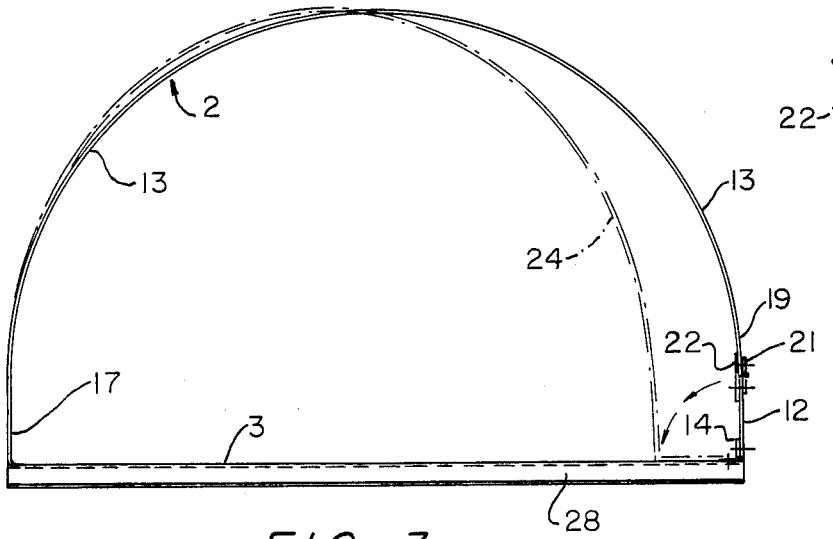
FIG. 3 is a front view showing the holder in expanded D-shaped (solid lines) and collapsed P-shaped (broken lines) modes.
Figure 4:
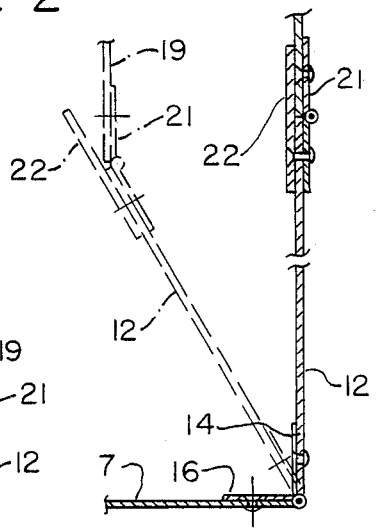
FIG. 4 is an enlarged and partially cross-sectional view of the hinge mechanism which permits transformation between the expanded and collapsed modes.
Figure 6:
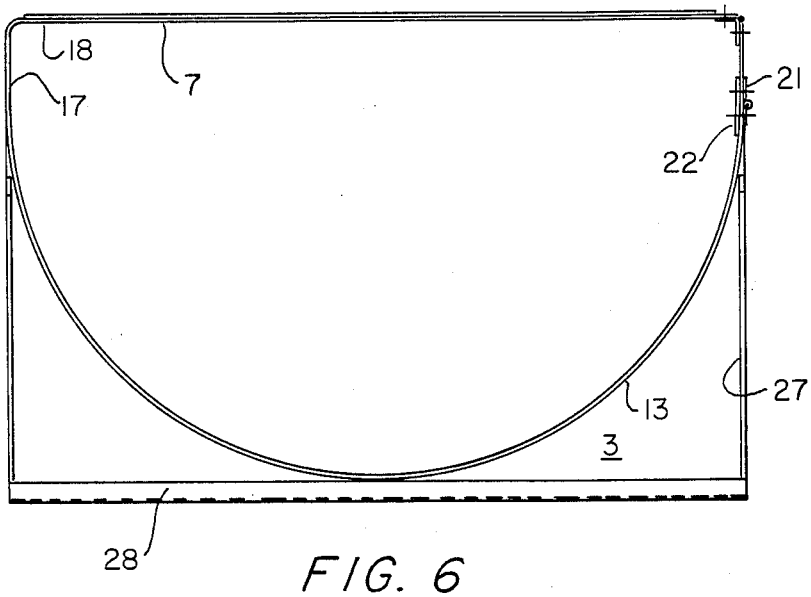
FIG. 6 is a plan view of the device folded for storage or shipping in the closed position.
Figure 7:
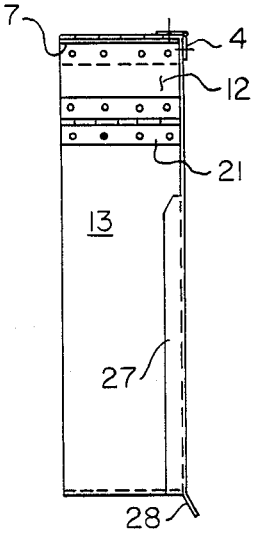
FIG. 7 is a side view of the device folded for storage or shipping in the closed position.
Figure 8:
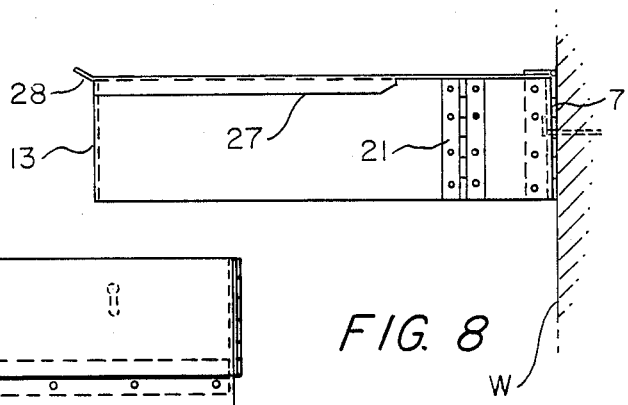
FIG. 8 is a side view of the device mounted on a wall in the closed position.
Figure 5:
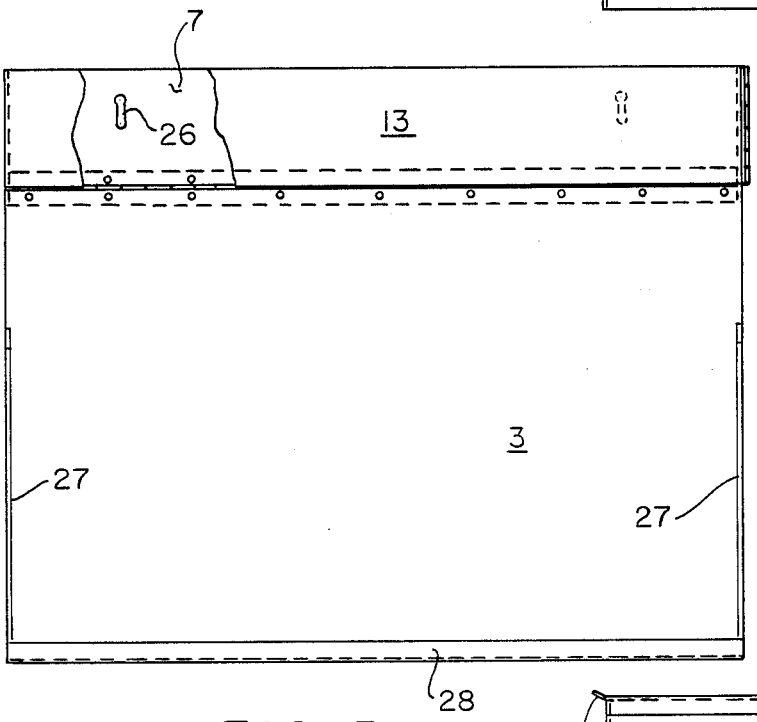
FIG. 5 is a plan view of the holder in expanded mode with the pan in the threshold position.
Figure 9:
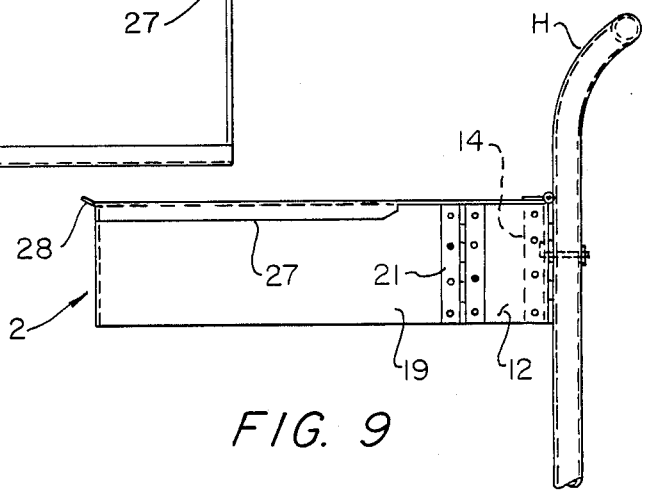
FIG. 9 is a side view of the device mounted on a frame member of a hand truck in the closed position.

The first and second hinges connecting the short segment 12 to the flat member 7 and the long segment 13, respectively, provide the possibility for two configurations or modes for the hoop 2: an expanded or D-shaped mode 23, and a collapsed or P-shaped mode 24 as illustrated in FIG. 3. In the D-shaped mode the long and short segments form a smooth curve representing an equilibrium between the tendency of the resilient segments to straighten, and the restriction placed upon this tendency by the stop formed by the overlapping of the segments at the second hinge 21. The P-shaped mode is assumed when the second hinge 21 is pressed inwardly, forcing the short segment to rotate about the first hinge and lie parallel to and in contact with the flat member 7, and positioning the long segment to form an approximate right angle with the short segment at the second hinge 21. This increases the flexing of the long segment, which now accounts for the entire curved portion of the hoop. It will be readily appreciated that the peripheral dimension of the hoop in the collapsed or P-shaped mode is less than that in the expanded or D-shaped mode, and this fact together with the ease with which the two modes may be alternated are important novel features of the present invention, because they permit the ready and rapid mounting of a bag on the hoop.

The flat member 7, in addition to serving as a site of attachment of the rectangular pan 3, provides a flat base upon which the hoop may rest in an upright freestanding position. The flat member is also supplied with keyhole slots 26 for mounting the hoop on a wall W or hand-cart H by means of suitable supports such as screws or hooks, for example.

The rectangular pan is provided with upwardly-directed perpendicular flanges 27 along the two side edges and a downwardly-angled front edge 28, the directions referring to the orientation of the side and front edges when the pan is positioned more or less horizontally to serve as an entrance ramp or threshold to the hoop. In this same position the mounting of the long hinge 4 is beneath the pan, thereby raising the rear edge of the pan slightly above the height of the flat member 7, and providing an elevated and unobstructed path for materials to be moved over the rear edge of the pan into the hoop. The flanged side edges help to direct the flow, and prevent materials from spilling sideways off the pan. The downwardly-angled front edge facilitates sweeping materials from the surrounding area onto the pan.

When the device is mounted on a wall or hand-cart the pan may serve either as a lid with the side flanges directed downwardly outside the hoop, or oriented vertically as a backplate, when the pan again serves to direct materials through the hoop. Folding the pan over the hoop also provides a convenient and compact size and shape for shipping and storage.

For mounting a trash bag on the hoop a variety of techniques may be employed. However, in the most favoured method, which is particularly valuable when the holder is to be used in a free-standing situation, as in a garden, the device is placed with the hoop in an upright position and the flat member of the hoop on the ground. The pan is also permitted to rest flat upon the ground. The operator stands with one foot on the pan to steady the device and exerts slight downward and inward hand pressure to the hoop at a point somewhat above the hinged section of the hoop. This pushes the hoop into the P-shaped configuration where it may be readily held with one hand. By slightly tilting the hoop towards the pan with the same hand the underside of the flat member is raised off the ground and one edge of the opening of a suitably-sized plastic or similar bag is introduced under the rear edge of the flat member with the other hand. The hoop is then tilted upright again and the remainder of the edge of the opening of the bag draped over and around the curved portion of the hoop. For the most satisfactory results it is best if the edge of the bag extends somewhat beyond the edge of the front, or pan side, of the hoop at all points. The hoop is then allowed to return to the D-shaped configuration in which, because of its now increased peripheral dimension, it tightens against the inner surface of the bag, holding the bag secure and ready for filling.

The invention may be made of any materials or combination of materials which provide sufficient strength, structural integrity and rigidity or flexibility as occasion demands. All aluminum construction is particularly favored, but other metals and some polymeric plastic materials may be equally suitable.

Although the invention has been described above by reference to a preferred embodiment in which the pan 3 is attached to the hoop 2, it may be noted that the hoop has utility in its own right in the absence of the pan. It will be appreciated that this, and other constructions and configurations that may be devised, are, nevertheless, within the scope and spirit of the invention and are defined and sought to be protected by Letters Patent of the United States as follows.

We claim:

1. A trach bag holder, comprising:

(a) a flat rectangular rigid member (7) having two long edges and two short edges, and having an inner surface and an outer surface;

(b) a short rectangular inherently resilient segment (12) having an inner surface and an outer surface, said short segment (12) having first and second short edges, said first short edge (14) attached by a first hinged connection (16) along a first short edge of said flat member (7), whereby the inner surface of said short segment (12) may be brought into contact with the inner surface of said flat member (7) by rotation about the first hinged connection (16), said second short edge (22) of said short segment being unattached; and (c) a long curved rectangular inherently resilient segment (13) having an inner surface and an outer surface, said long segment having a first short edge (17) rigidly attached to a second short edge (18) of said flat member (7) such that the surfaces of the flat member and long segment are perpendicular to each other at their intersection, said long curved segment having a second short edge (19) attached by a second hinged connection (21) to the outer surface of said short segment (12), said second hinged connection being axially parallel to and spaced between the first hinged connection (16) of said short segment and said unattached second short edge (22) of said short segment (12), whereby the outer surface of said short segment between the second hinged connection (21) and the unattached second short edge of said short segment may press against the inner surface of said long segment thereby to provide a stop limiting outward movement of the second hinged connection (21) to maintain a smooth curvature of the attached short and long segments between their respective attachments to said flat member (7), whereby a hoop structure is formed capable of being selectively transformed between:

(i) a contracted P-shaped mode wherein, by rotation about the first hinged connection (16), said short segment lies in contact with said flat member (7) and said short and long segments form a right angle at the second hinged connection (21), thereby facilitating the placement of the opening of a trash bag around the outer surfaces of the flat member and short and long segments, and (ii) an expanded D-shaped mode in which the flat member and short and long segments form an expanded periphery on which the trash bag is stretched and held firmly in place.

2. A trash bag holder according to claim 1, further including a rectangular pan (3) having upper and lower surfaces, said pan (3) having two upwardly perpendicular flanged side edges (27) and a downwardly angled front edge (28), said pan (3) having a rear edge (8) in hinged connection to a long edge (6) of said flat member such that the upper surface of said pan may be rotatably positioned in contact with the hinged edge of said hoop, whereby, depending upon the particular orientation chosen, the pan (3) may serve both as an entrance ramp for introducing trash into, and as a lid over, the D-shaped opening of the trash bag holder.

* * * * *